US009313595B1

(12) United States Patent
Jain et al.

(10) Patent No.: US 9,313,595 B1
(45) Date of Patent: Apr. 12, 2016

(54) LOW-POWER METHOD AND CIRCUITRY OF DETERMINING HEADPHONE TYPE AND MONITORING ACTIVITY

(71) Applicant: Marvell International Ltd., Hamilton (BM)

(72) Inventors: Kapil Jain, Santa Clara, CA (US); Sriharsha Annadore, San Jose, CA (US)

(73) Assignee: MARVELL INTERNATIONAL LTD., Hamilton (BM)

( * ) Notice: Subject to any disclaimer, the term of this patent is extended or adjusted under 35 U.S.C. 154(b) by 32 days.

(21) Appl. No.: 14/478,893

(22) Filed: Sep. 5, 2014

Related U.S. Application Data

(60) Provisional application No. 61/875,282, filed on Sep. 9, 2013.

(51) Int. Cl.
*H04R 29/00* (2006.01)
*H04R 1/10* (2006.01)

(52) U.S. Cl.
CPC ..... *H04R 29/00* (2013.01); *H04R 1/1091* (2013.01)

(58) Field of Classification Search
None
See application file for complete search history.

(56) References Cited

U.S. PATENT DOCUMENTS 6,970,752 B1 * 11/2005 Lim ..... H03M 11/24 381/123
2005/0053243 A1 * 3/2005 Ganton ..... H04R 5/04 381/58
2010/0075723 A1 * 3/2010 Min ..... H01R 24/58 455/569.1
2010/0303251 A1 * 12/2010 Im ..... H04R 1/1041 381/74
2011/0085673 A1 * 4/2011 Lee ..... H01R 24/58 381/74
2011/0091063 A1 * 4/2011 Lee ..... H04R 1/1091 381/384
2012/0051562 A1 * 3/2012 Kim ..... H04R 3/00 381/122
2012/0237051 A1 * 9/2012 Lee ..... H01R 13/66 381/74
2013/0058494 A1 * 3/2013 Kim ..... H03G 3/301 381/74
2013/0070937 A1 * 3/2013 Lee ..... H04R 1/1041 381/74
2013/0142350 A1 * 6/2013 Larsen ..... H04R 1/1041 381/74
2013/0259246 A1 * 10/2013 Kang ..... H04R 29/001 381/59
2014/0064503 A1 * 3/2014 Ko ..... H04R 29/001 381/59
2014/0064512 A1 * 3/2014 Yu ..... H01R 24/58 381/74
2015/0110331 A1 * 4/2015 Kwon ..... H04R 3/02 381/384
2015/0289055 A1 * 10/2015 Li ..... H04R 3/002 381/71.6

* cited by examiner

*Primary Examiner* — Peter Vincent Agustin

(57) ABSTRACT

A method includes detecting insertion of a headphone into an electronic device, comparing a voltage level detected by a detection circuit of the electronic device to a set of threshold voltages to determine a type of the headphone, determining the headphone to be a first type when a first signal travels through the first path to ground, and determining the headphone to be a second type when a second signal travels through the second path to charge the bias capacitor to a reference voltage. The detection circuit includes a first path, a second path, and a bias capacitor.

19 Claims, 13 Drawing Sheets

2-100A 2-100B

LOW-POWER METHOD AND CIRCUITRY OF DETERMINING HEADPHONE TYPE AND MONITORING ACTIVITY

CROSS REFERENCE TO RELATED APPLICATIONS

This present disclosure claims the benefit of U.S. Provisional Application No. 61/875,282, filed on Sep. 9, 2013, which is incorporated by reference herein in its entirety.

BACKGROUND

Electronic devices may receive connector plugs for headphones into sockets. For example, when a connector plug of a headphone is inserted into a socket of an electronic device, audio signals may be transmitted from the socket to the headphone through electrical connections formed between the socket and plug.

An electronic device may receive plugs of various types of headphones into a socket, including stereo headphones with plugs having three connection regions (i.e., poles) and stereo headsets with plugs having four connection regions. The electronic device may automatically determine the type of a received headphone. However, when a user inserts the plug of the received headphone into the socket of the electronic device, the plug of the headphone may not be properly inserted, thereby resulting in an erroneous determination of the type of the headphone.

SUMMARY

In an embodiment, a method includes detecting insertion of a headphone into an electronic device, comparing a voltage level detected by a detection circuit of the electronic device to a set of threshold voltages to determine a type of the headphone, determining the headphone to be a first type when a first signal travels through the first path to ground, and determining the headphone to be a second type when a second signal travels through the second path to charge the bias capacitor to a reference voltage. The detection circuit includes a first path, a second path, and a bias capacitor.

In an embodiment, the set of threshold voltages includes first and second threshold voltages and the first and second signals are first and second currents. The headphone is determined as the first type when the detected voltage level is less than the first threshold voltage. The headphone is determined as the second type when the detected voltage level is between the first and second threshold voltages. The second signal travels through the first path and the second path to charge the bias capacitor to the reference voltage.

In an embodiment, the first type is a 3-pole headphone type and the second type is a 4-pole headphone type.

In an embodiment, the first threshold voltage is determined using the reference voltage, a resistance value of a bias resistor, and a minimum resistance value of a microphone resistor.

In an embodiment, the second threshold voltage is determined using the reference voltage, a resistance value of a bias resistor, and a maximum resistance value of a microphone resistor.

In an embodiment, the method further includes activating a monitor circuit and an analog-digital-converter (ADC) during an on-duration of each detection cycle when the headphone is determined to be the first type, and comparing an output value of the ADC to a threshold value. The monitor circuit includes the first path and a monitor switch, and the on-duration is shorter than a period of each detection cycle.

In an embodiment, the method further includes determining the headphone as the second type and terminating the detection when the output value of the ADC is equal to or greater than the threshold value.

In an embodiment, the method further includes comparing a number of detection cycles to a given number of detection cycles when the output value of the ADC is less than the threshold value, terminating the detection and determining the headphone as the first type when the number of detection cycles is equal to the given number of detection cycles, and repeating the detection when the number of detection cycles is less than the given number of detection cycles.

In an embodiment, the method further includes activating a monitor circuit and an ADC during an on-duration of each detection cycle when the headphone is determined to be the second type and comparing an output value of the ADC to a threshold value. The monitor circuit includes the first path and a monitor switch.

In an embodiment, the reference voltage is a first reference voltage and the method further includes activating a micbias circuit to charge the bias capacitor to a second reference voltage when the output value of the ADC is equal to or less than the threshold value, and activating the ADC to identify the operation of one of controllers included in the headphone. The micbias circuit includes a buffer and the bias capacitor, and the second reference voltage has a voltage level that is substantially higher than a voltage level of the first reference voltage. The controllers are switching devices each configured to control a function in a system associated with the headphone.

In an embodiment, the method further includes repeating the monitoring when the output value of the ADC is greater than the threshold value.

In an embodiment, a system includes a detection circuit including a first path, a second path, and a bias capacitor, a processor, and a non-transitory computer readable medium having computer executable instructions stored thereon which, when executed by the processor, performs comparing a voltage level detected by the detection circuit to a set of threshold voltages to determine a type of a headphone, determining the headphone to be a first type when a first signal travels through the first path to ground, and determining the headphone to be a second type when a second signal travels through the second path to charge the bias capacitor to a reference voltage.

In an embodiment, the detection further includes an ADC configured to generate an output value corresponding to a voltage level at an input of the ADC.

In an embodiment, the output value of the ADC has 8 data bits.

In an embodiment, the detection circuit further includes a monitor circuit coupled to the input of the ADC. The monitor circuit has the first path and a monitor switch.

In an embodiment, the detection circuit further includes a buffer and the input of the ADC is coupled to an output of the buffer through the second path.

In an embodiment, the first path has a monitor resistor and the second path has a bias resistor. A resistance value of the monitor resistor is greater than a resistance value of the bias resistor.

DETAILED DESCRIPTION

Figure 1:
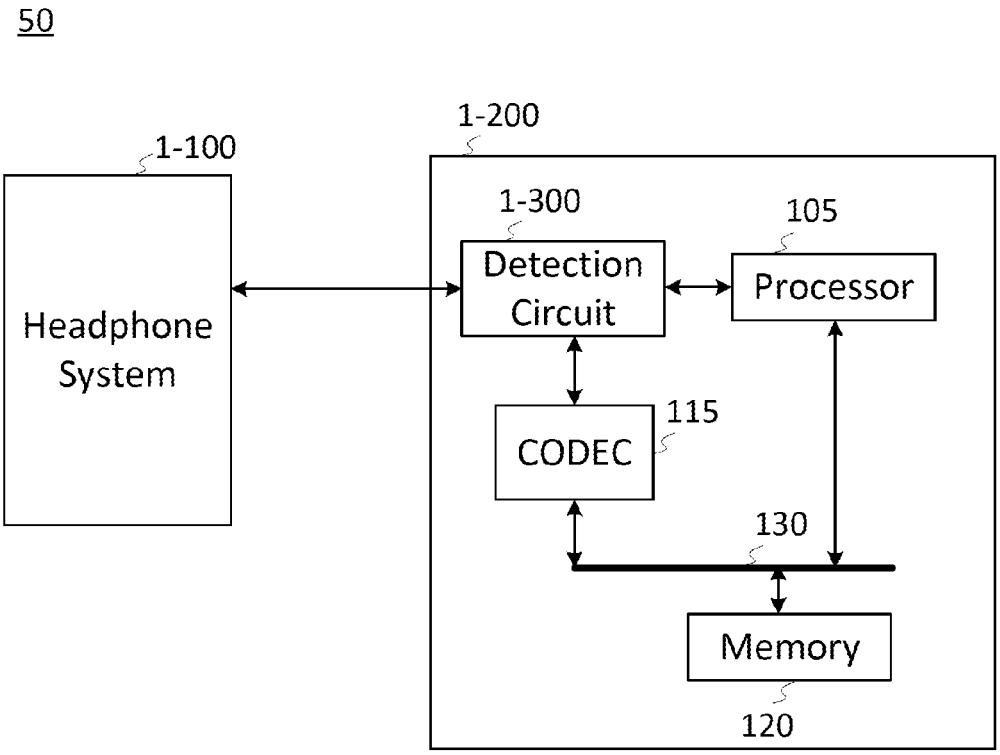
FIG. 1 is a block diagram of a headphone system and an electronic device according to an embodiment.

FIG. 1 shows an audio system 50 including a headphone system 1-100 and an electronic device 1-200 according to an embodiment. The electronic device 1-200 includes a detection circuit 1-300, a processor 105, a coder/decoder (CODEC) 115, a memory 120, and a bus 130.

The detection circuit 1-300 determines whether a plug of the headphone system 1-100 is inserted into a socket of the electronic device 1-200. The detection circuit 1-300 is used to determine a type of the headphone system 1-100 and monitor an operation of a switching device (or controllers) included in the headphone system 1-100.

In an embodiment, the detection circuit 1-300 transmits an output signal indicative of the type of the headphone system 1-100 to the processor 105. The processor 105 may interpret the signal to determine the type of the headphone system 1-100.

In an embodiment, the detection circuit 1-130 transmits an output signal indicative of an operation of a switching device included in the headphone system 1-100 to the processor 105. For example, the processor 105 may interpret the signal to determine which switching device has been turned on.

The CODEC 115 converts digital audio signals into analog signals to transmit the analog signals to the headphone system 1-100. The headphone system 1-100 converts the transmitted analog signals into sound.

The memory 120 is coupled to the CODEC 115 and the processor 105 through the bus 130. In an embodiment, the memory 120 includes cache, Flash, ROM, and/or RAM.

Figure 2A:
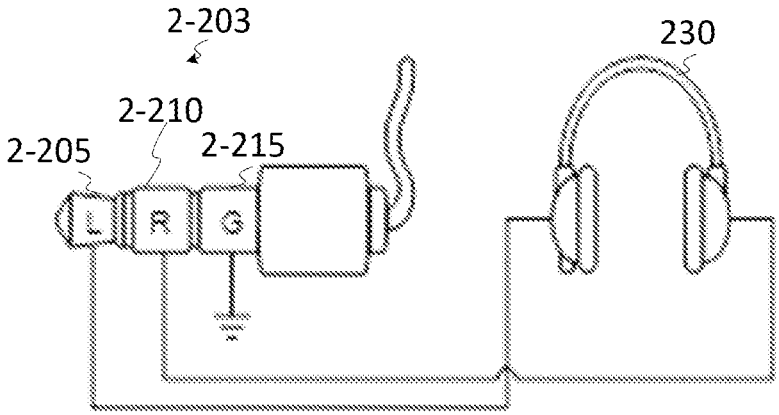
FIGS. 2A and 2B illustrate a 3-pole headphone system and a 4-pole headphone system, respectively, according to an embodiment.

FIG. 2A illustrates a 3-pole headphone system 2-100A suitable for use as the headphone system 1-100 of FIG. 1. The 3-pole headphone system 2-100A includes a headphone 230 and a plug 2-203 having a left audio signal connection 2-205, a right audio signal connection 2-210, and a ground connection 2-215. However, the order of the connections 2-205, 2-210, and 2-215 is not limited to the embodiment shown in FIG. 2A. For example, the left audio signal connection 2-205 and the right audio signal connection 2-210 may be interchanged.

Figure 2B:
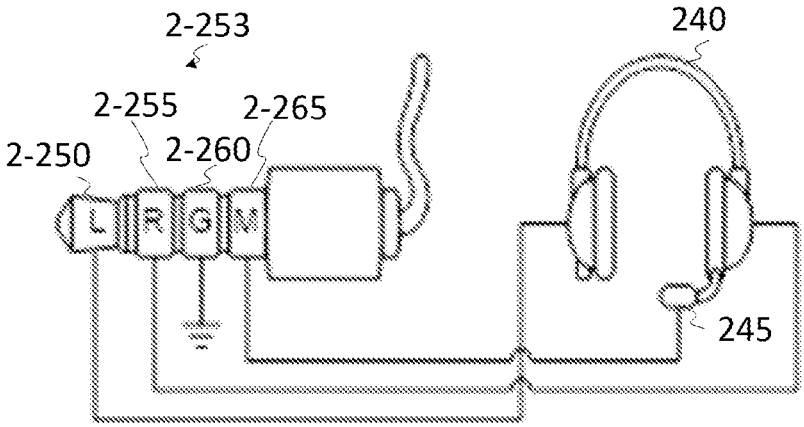

FIG. 2B illustrates a 4-pole headphone system (a stereo headset) 2-100B suitable for use as the headphone system 1-100 of FIG. 1. The 4-pole headphone system 2-100B includes a headphone with microphone 240 and a plug 2-253 having a left audio signal connection 2-250, a right audio signal connection 2-255, a ground connection 2-260, and a microphone connection 2-265. However, the order of the connections 2-250, 2-255, 2-260, and 2-265 is not limited to the embodiment shown in FIG. 2B.

In an embodiment, the 4-pole headphone system 2-100B includes a plurality of switching devices, each of which is used to trigger a predetermined action (e.g., increase or decrease volume, mute or unmute, etc.) Each switching device may be connected between the microphone connection 2-265 and the ground connection 2-260 in series with a resistor.

Figure 3:
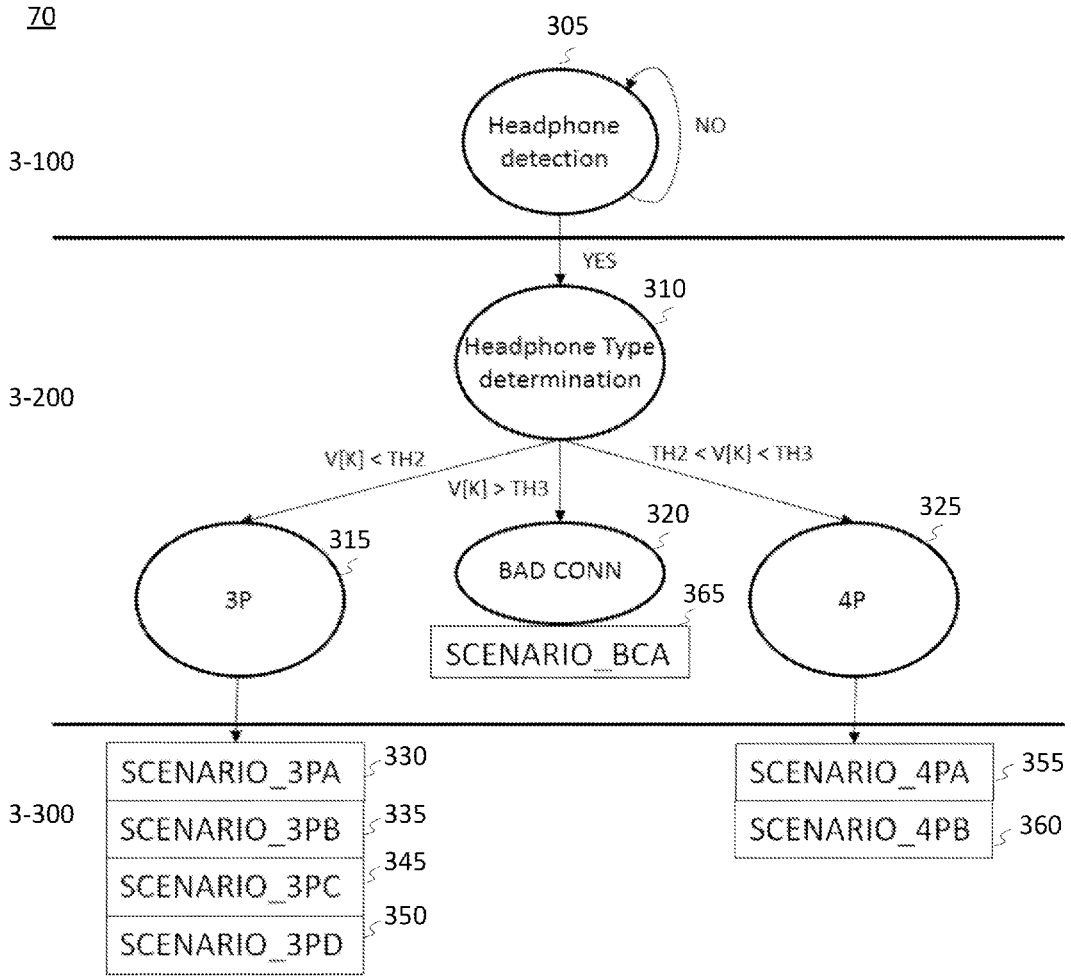
FIG. 3 is a diagram of a state machine for detecting a headphone, determining a type of the headphone, and monitoring activity on the headphone, according to an embodiment.

FIG. 3 illustrates a process 70 for detecting a headphone, determining a type of the headphone, and monitoring activity on the headphone, according to an embodiment, and a state machine used therein. In an embodiment, monitoring activity on a headphone includes confirming the type of headphone detected and determining which switching device (or controllers) included in the headphone has been turned on.

In the first stage 3-100, when an audio system 50 including the headphone system 1-100 and the electronic device 1-200 enters state 305, the detection circuit 1-300 of FIG. 1 operates to determine whether a plug of a headphone is inserted into a socket of the electronic device 1-200. For example, when a plug of the headphone is inserted into the socket, a normally closed switch in the socket can be mechanically opened to output a signal indicative of the insertion of the microphone. A person of ordinary skill in the art in light of the disclosures herein would understand other mechanical and/or electrical methods may be implemented to determine insertion of a plug into the socket of the electronic device 1-200.

In the second stage 3-200, the detection circuit 1-300 of FIG. 1 operates to determine the type of the headphone inserted during the first stage 3-100. In an embodiment, determination of the type of the inserted headphone is based on comparison of a voltage level detected by the detection circuit 1-300 to a set of threshold voltages, as will be described in more detail with reference to FIGS. 4A-4C. According to the comparison result, the audio system 50 enters into a 3P state 315, a 4P state 325, or a bad connection (BAD CONN) state 320, as shown in FIG. 3. The 3P state 315 indicates that the inserted headphone has been detected as being a 3-pole headphone type. The 4P state 325 indicates that the inserted headphone has been detected as being a 4-pole headphone type. The BAND CONN state 320 indicates a bad connection has been detected.

In the third stage 3-300, when the audio system 50 is in the 3P state 315, the audio system 50 may be configured in one of first through fifth scenarios 330 to 350 as shown in FIG. 3.

In the first scenario 330 (SCENARIO_3PA), the headphone determined as being the 3-pole headphone type is a properly inserted 3-pole headphone.

In the second scenario 335 (SCENARIO_3PB), the inserted headphone is actually a 4-pole headphone which has been determined to be the 3-pole headphone type due to improper insertion of the headphone plug into a socket. That is, the 4-pole headphone is inserted into the socket such that each connection of the 4-pole headphone contacts an incorrect terminal of the socket. For example, the 4-pole headphone is partially inserted such that the left audio signal connection, the right audio signal connection, and the ground connection of the 4-pole headphone contact to terminals corresponding to the right audio signal connection, the ground connection, and the microphone connection, respectively. In the third scenario 345 (SCENARIO_3PC), the inserted headphone is a 4-pole headphone which has been determined to be the 3-pole headphone type due to slow insertion of the headphone into a socket.

In the fourth scenario 350 (SCENARIO_3PD), the inserted headphone is a 4-pole headphone which has been determined to be the 3-pole headphone type due to an operation of a switching device included in the headphone system 1-100 of FIG. 1 during the insertion of the headphone.

Because the initial determination that the inserted headphone was a 3-pole headphone type is incorrect in the second through fourth scenarios 335, 345, and 350, the detection circuit 1-300 may operate to re-determine the headphone type, such as by repeatedly detecting the headphone type in order to conclusively determine a correct headphone type, as will be described in detail with reference to FIGS. 5A-5C and 6A-6C.

In the third stage 3-300, when the audio system is in the 4P state 325, the inserted headphone has been correctly detected as the 4-pole headphone type and the audio system 50 may be configured in one of a fifth and sixth scenarios 355 and 360. In the fifth scenario 355 (SCENARIO_4PA), a microphone of the inserted headphone is being used. In the sixth scenario 360 (SCENARIO_4PB), the microphone of the inserted headphone is not being used. In both the fifth and the sixth scenarios 355 and 360, a switching device included in the headphone system may be used, for instance, to change volume or mute, and accordingly the detection circuit 1-300 may repeatedly monitor operation of the switching device, as will be described in detail with reference to FIGS. 7A-7B.

Figure 4A:
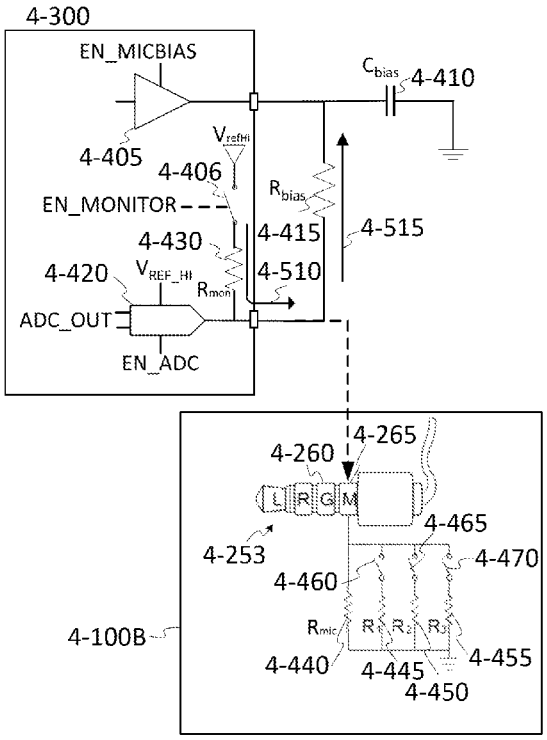
FIGS. 4A-4C illustrate initial determination of a headphone type according to an embodiment.

FIG. 4A is a circuit diagram of a portion of a detection circuit 4-300 when a plug 4-253 of a 4-pole headphone system 4-100B, similar to the 4-pole headphone system 2-100B shown in FIG. 2B, is inserted into a socket of an electronic device according to an embodiment. FIG. 4A shows circuit elements used for initial determination of a headphone type when the plug is inserted into a socket of the electronic device. The detection circuit 4-300 includes an analog-digital-converter (ADC) 4-420, a monitor circuit, and a microphone bias (micbias) circuit having a buffer 4-405, a bias capacitor 4-410, a bias resistor 4-415.

The monitor circuit includes a first path 4-510 that has a monitor resistor 4-430 and a switching device (a monitor switch) 4-406. The monitor circuit is activated in response to an active monitor signal EN_MONITOR to couple a node at an input of the ADC 4-420 to a power source supplying a high reference voltage $V_{refHi}$. When the monitor circuit is activated, a current flows through the first path 4-510 and a second path 4-515 that has the bias resistor 4-415 to charge the bias capacitor 4-410 to a first reference voltage $V_{ref1}$. For example, the bias capacitor 4-410 is charged until the voltage level at a first end of the bias capacitor 4-410 coupled to the bias resistor 4-415 reaches about 0.2 V. A second end of the bias capacitor 4-410 is connected to ground. An input of the ADC 4-420 is connected to a microphone connection 4-265 of the 4-pole headphone 4-100B.

Within the 4-pole headphone system 4-100B, the microphone connection 4-265 is connected to a first terminal of a microphone resistor 4-440, a first terminal of a first switch 4-460, a first terminal of a second switch 4-465, and a first terminal of a third switch 4-470. Second terminals of the first through third switches 4-460, 4-465, and 4-475 are connected to first terminals of a first switch resistor $R_1$, second switch resistor $R_2$, and third switch resistor $R_3$, respectively. Second terminals of the microphone resistor 4-440, first switch resistor $R_1$, second switch resistor $R_2$, and third switch resistor $R_3$ are connected to ground, that is, to a ground connection 4-260 of the headphone 4-100B.

When first to third switching devices (or controllers) 4-460 to 4-470 are open, the input of the ADC 4-420 is connected to the bias resistor 4-415 and the microphone resistor 4-440, which together operate as a voltage divider. As a result, when the monitor circuit is turned off, the voltage level $V_{ADC_IN}$ at the node connected to the input of the ADC 4-420 is represented by Equation 1:

$$V_{ADC_IN} = \frac{V_{ref1} * R_{mic}}{R_{mic} + R_{bias}}. \quad \text{Equation 1}$$

The resistance value $R_{mic}$ of the microphone resistor 4-440 may vary with, for example, a headphone type or a manufacturer of the headphone. In an embodiment, the resistance value $R_{mic}$ of the microphone resistor 4-440 ranges from 1 kΩ to 10 kΩ Where the resistance value $R_{mic}$ ranges from the minimum resistance value $R_{mic_min}$ to the maximum resistance value $R_{mic_max}$, the voltage level $V_{ADC_IN}$ at the node connected to the input of the ADC 4-420 is in the range between a second threshold voltage TH2 and a third threshold voltage TH3, as represented by Equation 2:

$$TH2 = \frac{V_{ref1} * R_{mic_min}}{R_{mic_min} + R_{bias}} \le V_{ADC_IN} \le TH3 = \frac{V_{ref1} * R_{mic_max}}{R_{mic_max} + R_{bias}}. \quad \text{Equation 2}$$

The ADC 4-420 converts the voltage level of the ADC input $V_{ADC_IN}$ into a value of an ADC output ADC_OUT in response to an ADC activation signal EN_ADC. In an embodiment, the value of the ADC output ADC_OUT has a number of data bits corresponding to 8 to 10 bits. As described in Equation 2, when a 4-pole headphone having a microphone and switches is inserted without operating any of the switches, the voltage level of the ADC input $V_{ADC_IN}$ is in the range between the second and third threshold voltages TH2 and TH3. As a result, referring to FIG. 4C, when a value of an ADC output ADC_OUT is in a range between the values corresponding to the second and third threshold voltages TH2 and TH3, the inserted headphone type is initially determined as the 4-pole headphone type. In an embodiment, the output value of the ADC is compared with the values corresponding to the second and third threshold voltages TH2 and TH3 in the processor 105 of FIG. 1 to determine the headphone type.

Figure 4B:
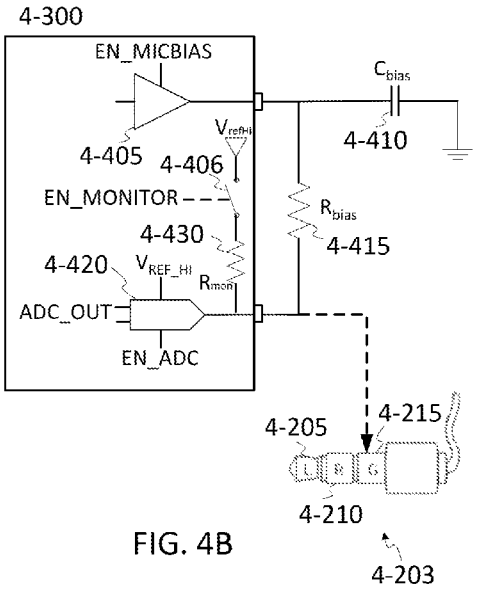

FIG. 4B is a circuit diagram of a portion of a detection circuit 4-300 when a plug of the 3-pole headphone system 2-100A of FIG. 2A is inserted into a socket of an electronic device according to an embodiment. FIG. 4B shows circuit elements used for initial determination of a type of a headphone when the headphone is inserted into a socket of the electronic device.

When a 3-pole headphone is inserted, a node connected to the input of the ADC 4-420 is connected to a ground connection 4-215 of a plug 4-203 of the inserted 3-pole headphone. As a result, a voltage level at the node connected to the input of the ADC 4-420 is lower than the second threshold voltage TH2. Thus, referring to FIG. 4C, if the value of the ADC output ADC_OUT is less the value corresponding to the second threshold voltage TH2, the inserted headphone type is initially determined as a 3-pole headphone.

When the value of the ADC output is greater than the third threshold voltage TH3, the audio system is determined as being in the BAD CONN state 320 of FIG. 3. As a result, the user of the audio system may be requested to remove and reinsert the headphone.

Figure 5A:
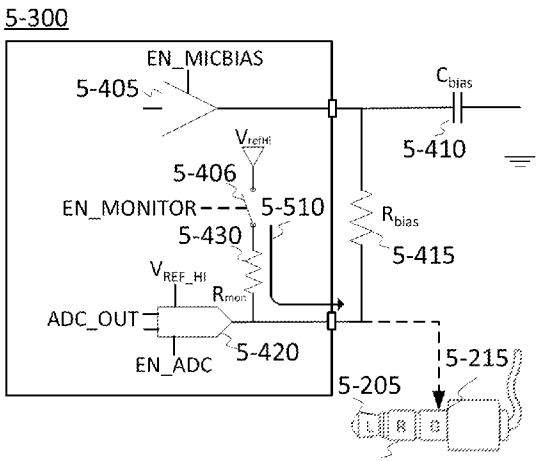
FIGS. 5A and 5B illustrate repetitive determination of a 3-pole headphone type according to an embodiment.
Figure 5B:
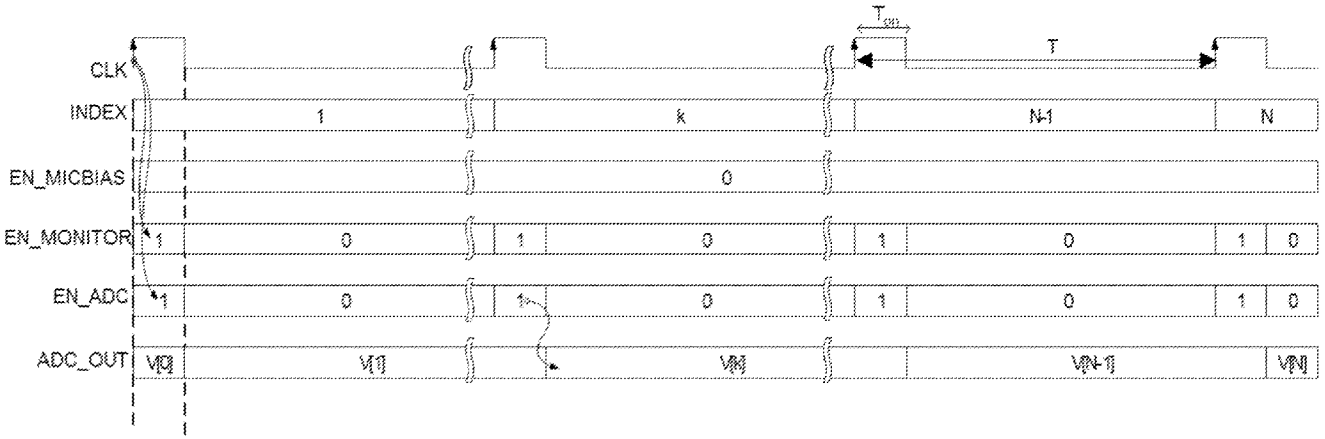

FIGS. 5A and 5B illustrate repetitive determination of a headphone type after the headphone is initially determined as a 3-pole headphone according to an embodiment. In this embodiment, the audio system including the headphone is in the first scenario 330 (SCENARIO_3PA) of FIG. 3, in which the headphone initially determined as being the 3-pole headphone is a 3-pole headphone.

FIG. 5A is a circuit diagram of a portion of a detection circuit 5-300 when a plug of the 3-pole headphone system 2-100A of FIG. 2A is inserted into an electronic device according to an embodiment. FIG. 5A shows circuit elements used for repetitive determination of a headphone type after the headphone is initially determined as a 3-pole headphone. The detection circuit 5-300 includes a monitor circuit, an ADC 5-420, and a micbias circuit.

The monitor circuit includes a first path 5-510 that has a monitor resistor 5-430 and a switching device (a monitor switch) 5-406. The monitor circuit is activated in response to an active monitor signal EN_MONITOR to couple a node at an input of the ADC 5-420 to a high reference voltage $V_{refHi}$.

The micbias circuit has a buffer 5-405, a bias capacitor 5-410, and a bias resistor 5-415. The monitor resistor 5-430 has a resistance value $R_{mon}$, which is substantially greater than a resistance value $R_{bias}$ of the bias resistor 5-415. In an embodiment, the resistance value $R_{mon}$ of the monitor resistor 5-430 is about ten times greater than the resistance value $R_{bias}$ of the bias resistor 5-415.

FIG. 5B illustrates a waveform of a clock signal CLK and values of an index INDEX corresponding to a number of detection cycles, a mic-bias signal EN_MICBIAS, a monitor signal EN_MONITOR, an ADC activation signal EN_ADC, and an output ADC_OUT of an ADC 5-420. A rising edge of the clock signal CLK corresponds to the start of each detection period T and causes the monitor signal EN_MONITOR and the ADC activation signal EN_ADC to have a logic high value (e.g., "1"). During the detection cycles, the mic-bias signal EN_MICBIAS continues to have a logic low value (e.g., "0") and the buffer 5-405 remains deactivated.

The clock signal CLK, the monitor signal EN_MONITOR, and the ADC activation signal EN_ADC each have the logic high value during a turn-on period Ton. The turn-on period Ton is shorter than the detection period T. In an embodiment, the turn-on period Ton is about 10% of the detection period T.

During the turn-on period Ton, the switching device 5-406 is closed and a current flows through the first path 5-510 to the ground connection 5-215. Thus, a voltage level at the node connected to the input of the ADC is lower than the second threshold voltage TH2 of FIG. 4C. As a result, where N is the maximum number of the detection cycles, a value V[k] of the ADC output ADC_OUT corresponding to the $k^{th}$ detection cycle satisfies the following Equation 3:

$$V[k] < TH2 = \frac{V_{ref1} * R_{mic_min}}{R_{mic_min} + R_{bias}} \quad \text{where } k = 1, 2, \ldots, N. \qquad \text{Equation 3}$$

When Equation 3 is satisfied for all the detection cycles, the type of the headphone is conclusively determined as the 3-pole headphone.

In an embodiment, the micbias circuit including the buffer 5-405 is not used in repetitive determination of a headphone type after the headphone is initially determined as a 3-pole headphone. The total amount of currents in an embodiment of repeatedly detecting a headphone type is substantially less than that in a conventional method in which a micbias circuit is used to repeatedly detect a headphone type. As a result, the power consumption in an embodiment of the present disclosure is reduced compared to the power consumption using the conventional method.

Figure 6A:
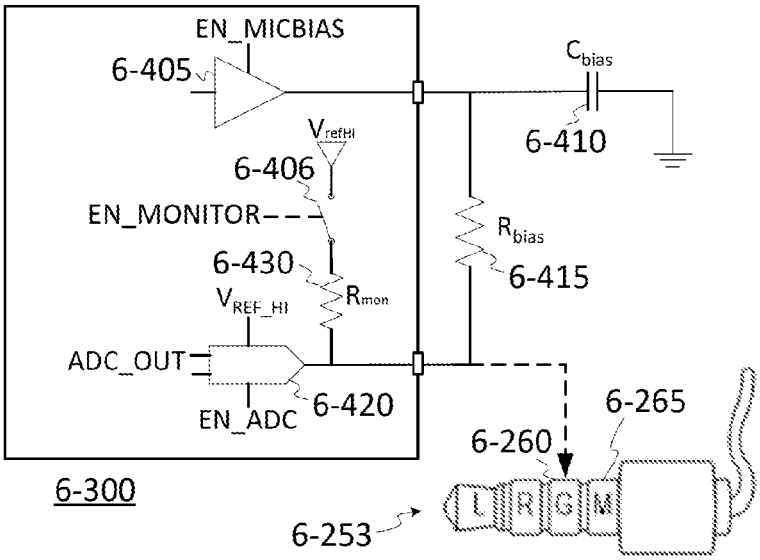
FIGS. 6A to 6C illustrate repetitive determination of a 4-pole headphone type according to an embodiment.

FIG. 6A illustrates an audio system including a headphone in the second and third scenarios 335 (SCENARIO_3PB) and 345 (SCENARIO_3PC), in which the headphone initially determined as being a 3-pole headphone is actually a 4-pole headphone. That is, because the headphone is improperly inserted or slowly inserted into the electronic device, a node connected to an input of the ADC 6-420 during an initial determination of the headphone type is connected to a ground connection 6-260 of a plug as shown in FIG. 6A. Thus, a voltage level at the node connected to the input of the ADC 6-420 is less than the second threshold voltage TH2 of FIG. 4C, and the headphone is initially determined as a 3-pole headphone.

Figure 6B:
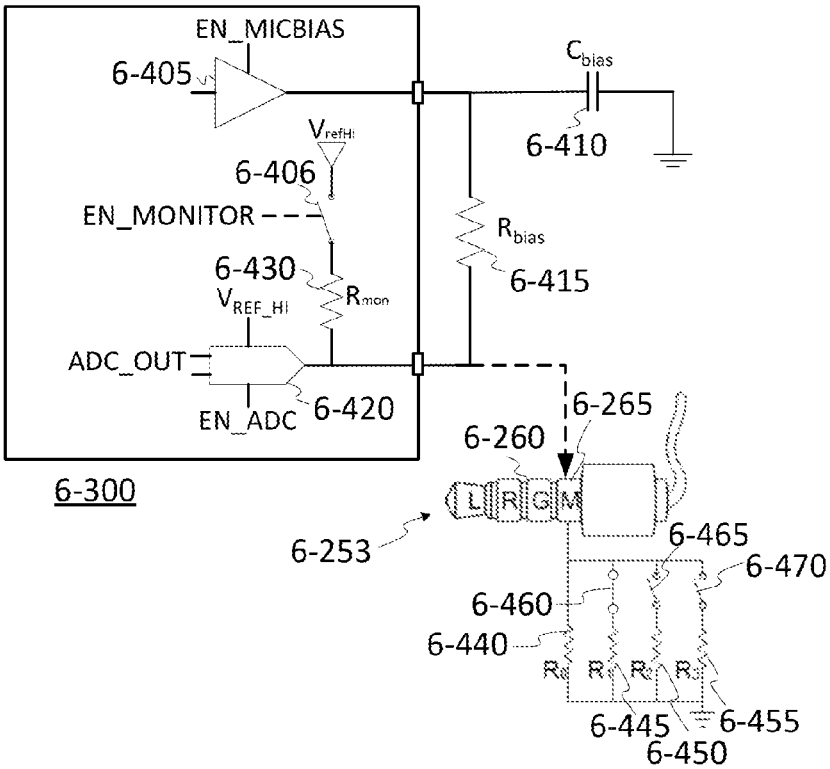

FIG. 6B illustrates an audio system including a headphone is in the fourth scenario 350 (SCENARIO_3PD), in which the headphone initially determined as being a 3-pole headphone is actually a 4-pole headphone. Under the fourth scenario 350 (SCENARIO_3PD), a first switching device 6-460 is turned on while the headphone is inserted as shown in FIG. 6B.

As a result, the node connected to the input of the ADC 6-420 during an initial determination of the headphone type is connected through a microphone connection 6-265 to a microphone resistor 6-440 and a first switch resistor 6-445. A resistance value $R_{mic}$ of the microphone resistor 6-440 is greater than respective resistance values $R_1$, $R_2$, and $R_3$ of first, second, and third switch resistors 6-445, 6-450, and 6-455. During the initial determination of the headphone type, the monitor circuit is turned on and a current flows through a monitor resistor 6-430 and a bias resistor 6-415 to charge the bias capacitor 6-410 to a first reference voltage $V_{ref1}$. In an embodiment, when the monitor circuit is turned off, since the resistance value $R_{mic}$ of the microphone resistor 6-440 is sufficiently large that most of the current flows through the first switch resistor 6-445, rather than through the microphone resistor 6-440A, a voltage level at the node connected to the input of the ADC 6-410 is represented by Equation 4:

$$V_{ADC_{IN},sw1} = \frac{V_{ref1} + R_1}{R_{bias} + R_1}. \qquad \text{Equation 4}$$

Similarly, when a second switching device 6-465 is turned on during the initial determination of the headphone type, the voltage level at the node connected to the input of the ADC 6-410 is represented by Equation 5:

$$V_{ADC_{IN},sw2} = \frac{V_{ref1} + R_2}{R_{bias} + R_2}. \qquad \text{Equation 5}$$

When a third switching device 6-470 is turned on during the initial determination of the headphone type, the voltage level at the node connected to the input of the ADC 6-410 is represented by Equation 6:

$$V_{ADC_{IN},sw3} = \frac{V_{ref1} + R_3}{R_{bias} + R_3}. \quad \text{Equation 6}$$

Figure 4C:
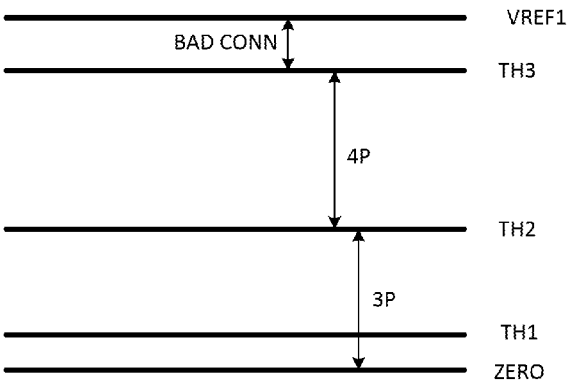

Defining the first threshold voltage TH1 as the maximum value of the voltage levels represented by Equations 4 to 6, the first threshold voltage TH1 is less than the second threshold voltage TH2 as shown in FIG. 4C. As a result, when any of the switching devices (or controllers) 4-460, 4-465, and 4-470 is turned on during the initial determination of the headphone type, the headphone is incorrectly determined as being a 3-pole headphone type, although the headphone is a 4-pole headphone.

Under the above-described second, third, and fourth scenarios 335 (SCENARIO_3PB), 345 (SCENARIO_3PC), and 350 (SCENARIO_3PD), the 4-pole headphone is initially determined as being the 3-pole headphone type. Thus, when a headphone is initially determined as a 3-pole headphone type, a re-determine of the type of the headphone is performed to determine whether the initial determination is correct, as will be described below with reference to FIG. 6C.

Figure 6C:
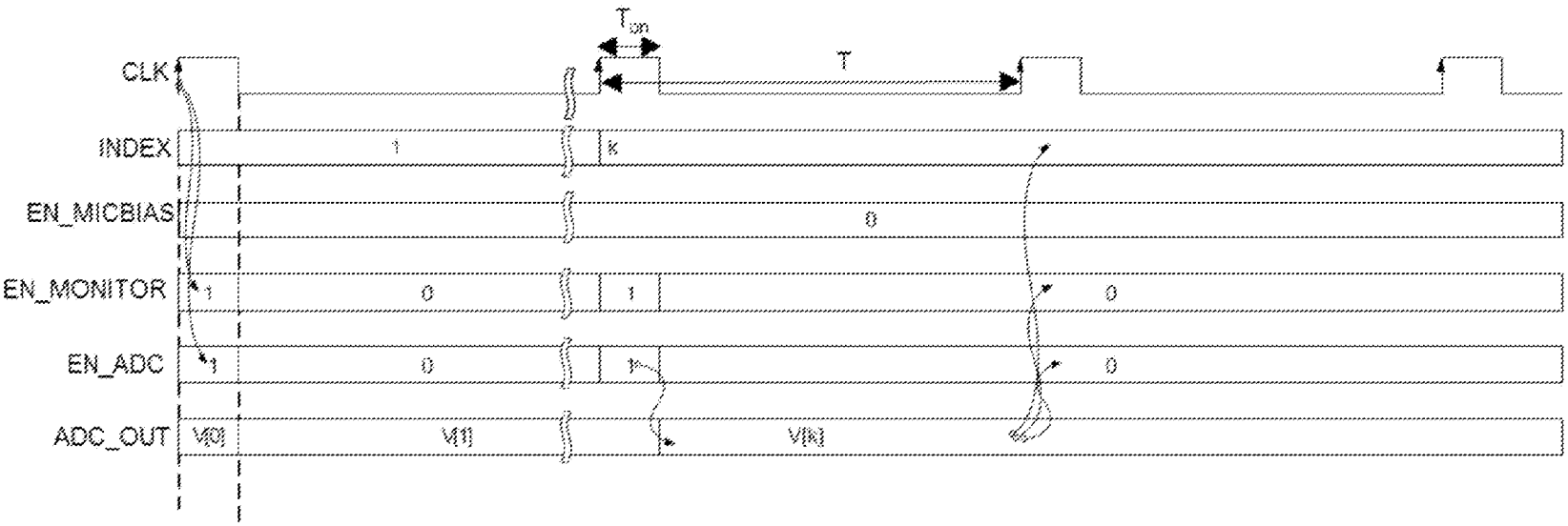

FIG. 6C illustrates a waveform of a clock signal CLK and values of an index INDEX corresponding to a number of detection cycles, a mic-bias signal EN_MICBIAS, a monitor signal EN_MONITOR, an ADC activation signal EN_ADC, and an output ADC_OUT of an ADC 6-420. A rising edge of the clock signal CLK corresponds to the start of each detection period T and causes the monitor signal EN_MONITOR and the ADC activation signal EN_ADC to have a logic high value (e.g., "1").

When the plug 6-253 is improperly inserted, slowly inserted, or one of the switches 6-460, 6-465, and 6-470 is pressed up to the $k-1^{th}$ detection cycle, the voltage level at the node connected to the input of the ADC is lower than the second threshold voltage TH2 of FIG. 4C. Thus, a value V[i] of the ADC output ADC_OUT corresponding to the $i^{th}$ detection cycle satisfies the following Equation 7:

$$V[i] < TH2 = \frac{V_{ref1} * R_{mic_min}}{R_{mic_min} + R_{bias}} \quad \text{where } i = 1, 2, \ldots, k-1. \quad \text{Equation 7}$$

When, at a time after the initial determination, the plug 6-253 is properly inserted and none of the switches 6-460, 6-465, and 6-470 are turned on before the $k^{th}$ detection cycle starts, the voltage level at the node connected to the input of the ADC becomes equal to or greater than the second threshold voltage TH2 of FIG. 4C at the $k^{th}$ detection cycle. That is, a value V[k] of the ADC output ADC_OUT corresponding to the $k^{th}$ detection cycle satisfies the following Equation 8:

$$V[k] \geq TH2 = \frac{V_{ref1} * R_{mic_min}}{R_{mic_{min}} + R_{bias}}. \quad \text{Equation 8}$$

Once the value V[k] of the ADC output ADC_OUT corresponding to the $k^{th}$ detection cycle satisfies the above equation, the type of the headphone is conclusively determined as the 4-pole headphone type and the values of the monitor signal EN_MONITOR and the ADC activation signal EN_ADC are set to have a logic low value (e.g., "0"). As a result, further detection is not performed as shown in FIG. 6C after the $k^{th}$ detection cycle.

In an embodiment, the micbias circuit including the buffer 6-405 is not used in repetitive determination of a headphone type after the headphone is initially determined as a 3-pole headphone. The total amount of currents in an embodiment of repeatedly detecting a headphone type is substantially less than that in a conventional method in which a micbias circuit is used to repeatedly detect a headphone type. As a result, the power consumption in an embodiment of the present disclosure is reduced compared to the power consumption using the conventional method.

Figure 7A:
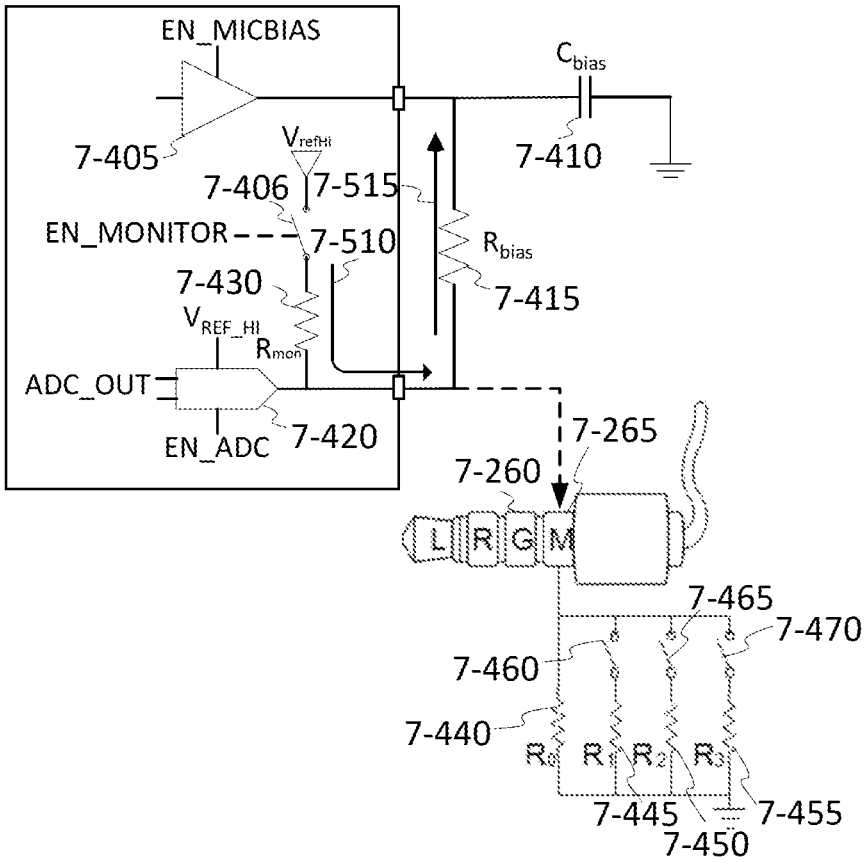
FIGS. 7A and 7B illustrate repetitive monitoring of a switch operation of the 4-pole headphone system shown in FIG. 2B according to an embodiment.

FIG. 7A illustrates an audio system including a headphone is in states 360 of FIG. 3 corresponding to the sixth scenario 355 (SCENARIO_4PB), in which the headphone is initially determined as the 4-pole headphone and a microphone is not used. However, a user may operate one of first, second, and third switching devices (or controllers) 7-460, 7-465, and 7-470 to trigger a predetermined action, for example, increasing/decreasing volume, mute/unmute, or the like. Thus, repetitive monitoring of operation of the first, second, and third switching devices 7-460, 7-465, and 7-470 is performed will be described below with reference to FIG. 7B.

Figure 7B:
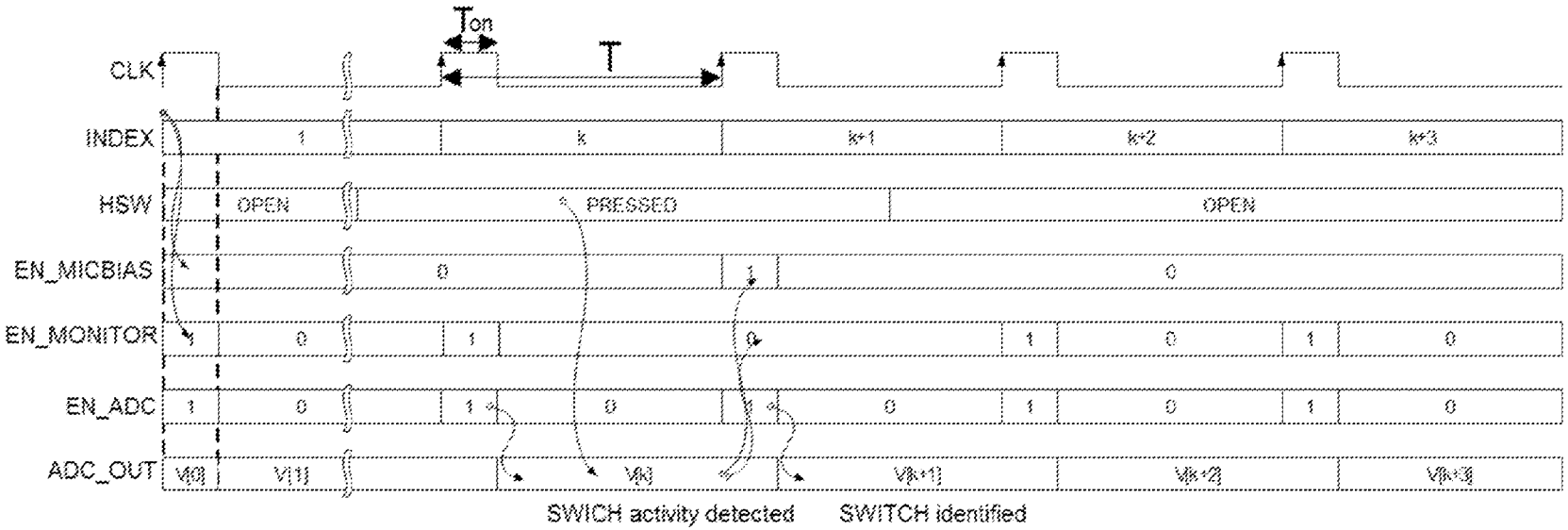

FIG. 7B illustrates a waveform of a clock signal CLK and values of an index INDEX corresponding to a number of monitoring cycles, a mic-bias signal EN_MICBIAS, a monitor signal EN_MONITOR, an ADC activation signal EN_ADC, and an output ADC_OUT of an ADC 7-420. A rising edge of the clock signal CLK corresponds to the start of each monitoring period T and causes the monitor signal EN_MONITOR and the ADC activation signal EN_ADC to have a logic high value (e.g., "1").

When none of the first, second, and third switching devices 7-460, 7-465, and 7-470 is turned on up to the $k-1^{th}$ monitoring cycle, a microphone resistor 7-440 is connected to a microphone connection 7-265 as shown in FIG. 7A. During a turn-on period Ton, a current (or signal) flows through a first path 7-510 including the monitor resistor 7-430 and a second path 7-515 including the bias resistor 7-415 to charge the bias capacitor 7-410 to a first reference voltage $V_{ref1}$. As a result, when the monitor circuit is turned off, a voltage level at the node connected to the input of the ADC 7-420 is equal to or greater than the second threshold voltage TH2 of FIG. 4C. That is, a value V[i] of the ADC output ADC_OUT corresponding to the $i^{th}$ monitoring cycle satisfies the following Equation 9:

$$V[i] \geq TH2 = \frac{V_{ref1} * R_{mic_min}}{R_{mic_min} + R_{bias}} \quad \text{where } i = 1, 2, \ldots, k-1. \quad \text{Equation 9}$$

When a first switching device 7-460 is turned on before the $k^{th}$ monitoring cycle starts as shown in FIG. 7B, the microphone resistor 7-440 and the first switch resistor 7-445 are connected to the microphone connection 7-265. As a result, the voltage level at the node connected to the input of the ADC becomes less than the first threshold voltage TH1 of FIG. 4C. That is, a value V[k] of the ADC output ADC_OUT corresponding to the $k^{th}$ monitoring cycle satisfies the following Equation 10:

$$V[k] < TH1 = \frac{V_{ref1} * \max\{R_1, R_2, R_3\}}{R_{bias} + \max\{R_1, R_2, R_3\}}. \quad \text{Equation 10}$$

When the value V[k] of the ADC output ADC_OUT corresponding to the $k^{th}$ monitoring cycle satisfies the above equation, it is determined that one of the switches 7-460, 7-465, and 7-470 is pressed.

In an embodiment, the resolution of the ADC 7-420 may not permit the identification of which one of the first, second, and third switches 7-460, 7-465, and 7-470 was pressed in the $k^{th}$ monitoring cycle. To identify the turned on switch (e.g., the first switch 6-460 as shown in FIG. 6B), the rising edge of the clock signal CLK corresponding to the start of the $k+1^{th}$ monitoring cycle causes the mic-bias signal EN_MICBIAS and the ADC activation signal EN_ADC to have the logic high value and the monitor signal EN_MONITOR to have the logic low value. As a result, a current (or signal) flows to charge the bias capacitor 7-410 to a second reference voltage $V_{ref2}$ during the turn-on period Ton corresponding to the $k+1^{th}$ monitoring cycle. For example, the bias capacitor 7-410 is charged until the voltage level at a first end of the bias capacitor 7-410 coupled to the bias resistor 7-415 reaches about 1.8 V. Since the bias capacitor 7-410 is charged to the second reference voltage $V_{ref2}$ that has a level substantially higher than that of the first reference voltage $V_{ref1}$, a voltage level at the input of the ADC 7-420 when one of the first, second, and third switches 7-460, 7-465, and 7-470 is turned on is large enough to identify the pressed switch using the ADC 7-420. The pressed switch may be identified by comparing a value of an output ADC_OUT of the ADC 7-420 to a set of threshold values corresponding to the first, second, and third switches 7-460, 7-465, and 7-470. Once the turned on switch is identified, an appropriate action (e.g., increase or decrease volume, mute or unmute, etc.) is taken based on the identified switch.

Once the turned on switch is identified as described above, a rising edge of the clock signal CLK corresponding to the start of the $k+2^{th}$ monitoring cycle and subsequent monitoring cycles causes the mic-bias signal EN_MICBIAS to have the logic low value and the monitor signal EN_MONITOR and the ADC activation signal EN_ADC to have the logic high value, until one of the first, second, and third switches 7-460, 7-465, and 7-470 is turned on again. When one of the first, second, and third switches 7-460, 7-465, and 7-470 is turned on again, the process to monitor and identify the turned on switch is performed as described above.

In an embodiment, during the monitoring cycles except when a turned on switch is identified, the mic-bias signal EN_MICBIAS continues to have a logic low value (e.g., "0") and the buffer 7-405 remains deactivated. As a result, the power consumption in an embodiment of the present disclosure is reduced compared to the power consumption using a conventional method in which a micbias circuit is activated during substantially all the monitoring cycles to repeatedly monitor a switch operation.

Figure 8:
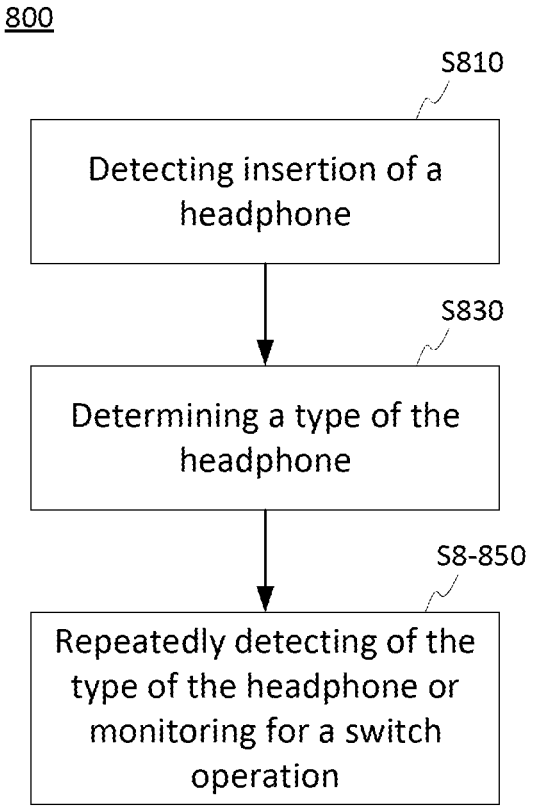
FIG. 8 is a flowchart of a process of determining a headphone type and monitoring a switch operation according to an embodiment.

FIG. 8 is a flowchart of a process of determining a headphone type and monitoring a switch operation according to an embodiment.

At S810, whether a headphone is inserted into an electronic device is determined. In an embodiment, a normally closed switch in a socket of the electronic device is mechanically opened when a plug of a headphone is inserted in the socket to output a signal indicating insertion of the plug.

At S830, a type of the inserted headphone is initially determined. For example, the inserted headphone is initially determined as a 3-pole headphone type or a 4-pole headphone type, or a bad connection state may be detected. In an embodiment, the type of the inserted headphone is determined based on comparison of a voltage level detected by a detection circuit of the electronic device to a set of threshold voltages.

At S8-850, determination of the headphone type or monitoring for a switch operation is performed repeatedly for a number of detection cycles. In an embodiment, the repetitive determination of the headphone type is performed when the headphone has been initially determined as a 3-pole headphone at S830. In an embodiment, the repetitive monitoring for a switch operation is performed when the headphone has been determined as a 4-pole headphone at S380.

Figure 9A:
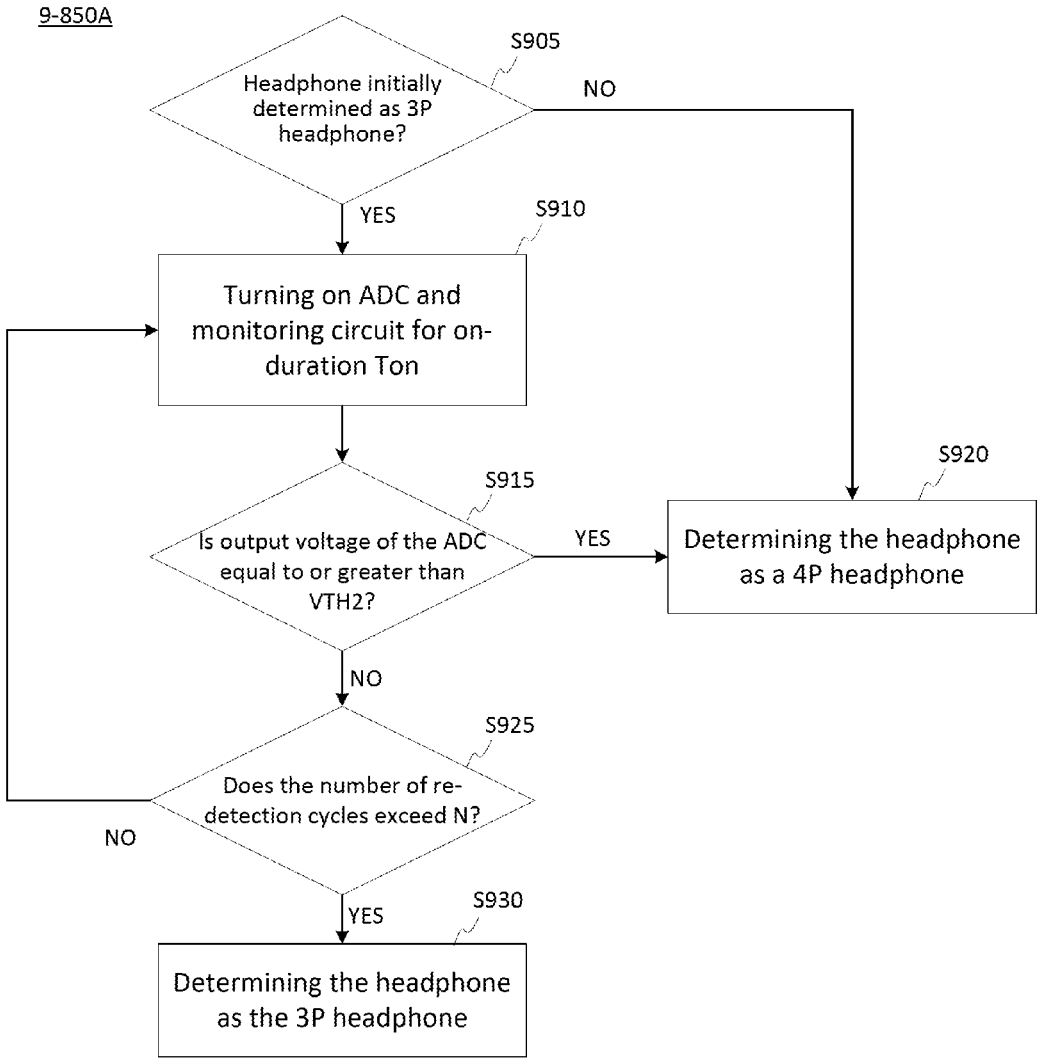
FIG. 9A illustrates a process of repetitive determination of a headphone type according to an embodiment.

FIG. 9A illustrates a process 9-850A of repetitive determination of a headphone type according to an embodiment.

At S905, whether a headphone inserted into an electronic device was initially determined as a 3-pole headphone type is determined. If so, then beginning at S910, the process 9-850 re-determines the type of the headphone. If not, at S920 the headphone is determined to be the 4-pole headphone type.

At S910, a monitor circuit and an ADC are activated during a turn-on period, which is shorter than a detection period T. In an embodiment, a rising edge of a clock signal corresponding to the start of each detection period T causes a monitor signal to have a logic high value and the monitor circuit is activated. When the inserted headphone is a 3-pole headphone, a current flows through a first path included in the monitor circuit to a ground connection of the 3-pole headphone during the turn-on period. When the inserted headphone is a 4-pole headphone, a current (or signal) flows through the first path and a second path included in the bias circuit to charge a bias capacitor to a first reference voltage.

At S915, a value of an ADC output at each detection cycle is compared to the second threshold voltage TH2 of FIG. 4C. If the value of the ADC output is equal to or greater than the second threshold voltage TH2, at S920 the headphone is conclusively determined as the 4-pole headphone type and no further detection cycle is performed.

If the value of the ADC output is less than the threshold voltage TH2, at S925 the electronic device checks whether the number of detection cycles is less than a predetermined maximum number N of detection cycles. When the number of detection cycles is less than the maximum number N of detection cycles, the method 9-850A proceeds to S910 to perform the next detection cycle. When the number of detection cycles is equal to the maximum number N of detection cycles, the headphone is conclusively determined as the 3-pole headphone type.

Figure 9B:
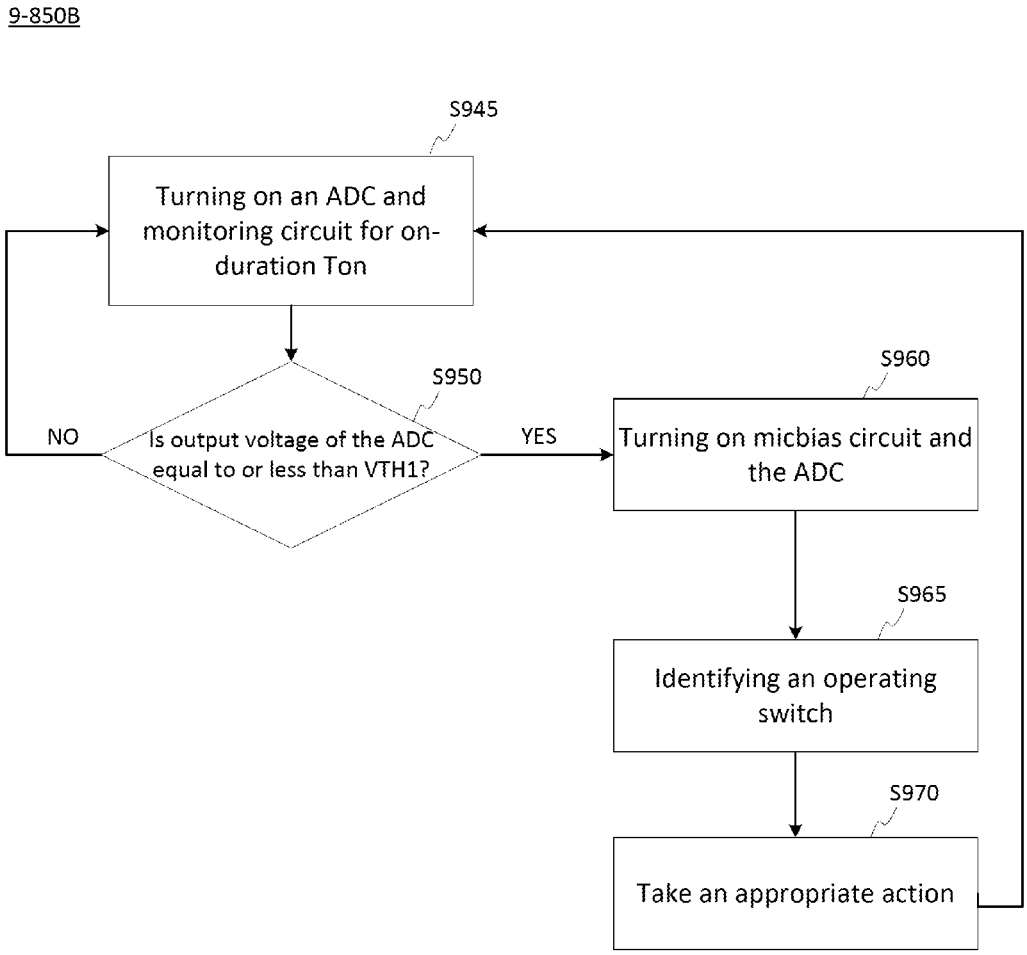
FIG. 9B illustrates a process of repetitive monitoring of a switch operation according to an embodiment

FIG. 9B illustrates a process 9-850B of repetitive monitoring of a switch operation according to an embodiment. Process 9-850B may be performed when a headphone has initially or conclusively determined to be the 4-pole headphone type.

At S945, a monitor circuit and an ADC are activated during a turn-on period Ton, which is shorter than a detection period T. In an embodiment, a rising edge of a clock signal corresponding to the start of each detection period T causes a monitor signal to have a logic high value and the monitor circuit is activated. As a result, a current (or signal) flows through the first path and the second path to charge the bias capacitor to the first reference voltage.

At S950, a value of an ADC output at each monitoring cycle is compared to a first threshold voltage TH1. If the value of the ADC output is equal to or less than the first threshold voltage TH1, it indicates that one of switching devices (or controllers) of the headphone is operating. Subsequently, at S960 a mic-bias signal is activated to cause a current (or signal) flows to charge the bias capacitor to a second reference voltage $V_{ref2}$ to identify an operating switch. Since the bias capacitor is charged to the second reference voltage $V_{ref2}$ that has a level substantially higher than that of the first reference voltage $V_{ref1}$, a voltage level at the input of the ADC when one of the switching devices is turned on is large enough to identify the pressed switch using the ADC. At S965, the operating switch is identified using the ADC. At S970, a predetermined action is taken based on the identified switch.

Subsequently, the method 9-850B proceeds to S945 to continue monitoring an operating switch.

If the value of the ADC output is greater than the threshold voltage TH1, it indicates that none of the switching devices of the headphone is operating and the method 9-850B proceeds to S975. Thus, the method 9-850B proceeds to S945 to continue monitoring an operating switch.

Figure 10:
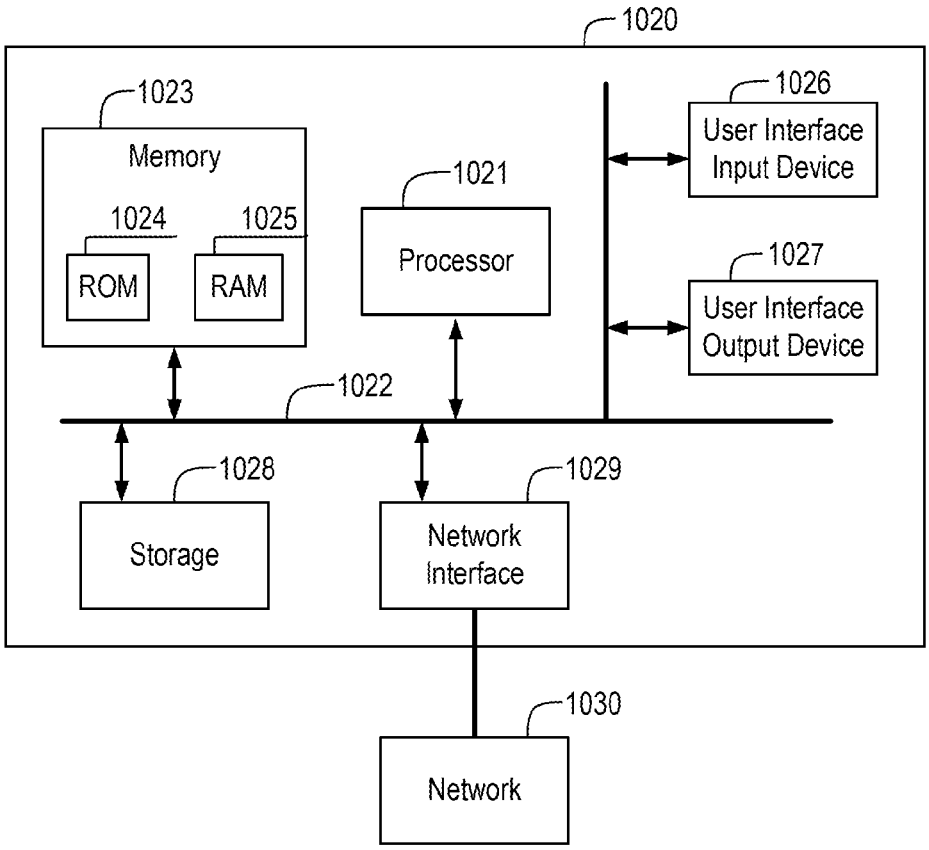
FIG. 10 illustrates a block diagram of a computer system in accordance with an embodiment.

Embodiments of the present disclosure may be implemented in a computer system or on a non-transitory computer readable medium. FIG. 10 illustrates a computer system 1020 including a processor 1021, a bus 1022, a memory 1023, and a user interface input device 1026, a user interface output device 1027, a storage 1028, and a network interface 1029 that is coupled to a network 1030. The processor 1021 may be a central processing unit (CPU) or a semiconductor device that executes processing instructions stored in the memory 1023 and/or the storage 1028. The memory 1023 and the storage 1028 may include various forms of volatile or non-volatile storage media. For example, the memory 1023 may include a ROM 1024 and a RAM 1025.

Accordingly, an embodiment of the present disclosure may be implemented as a computer implemented method or as a non-transitory computer readable medium with computer executable instructions stored thereon. In an embodiment, when executed by the processor, the computer readable instructions may perform a method according to at least one aspect of the present disclosure.

Aspects of the present disclosure have been described in conjunction with the specific embodiments thereof that are proposed as examples. Numerous alternatives, modifications, and variations to the embodiments as set forth herein may be made without departing from the scope of the claims set forth below. Accordingly, embodiments as set forth herein are intended to be illustrative and not limiting.

What is claimed is:

1. A method comprising:

detecting insertion of a headphone into an electronic device;

comparing a voltage level detected by a detection circuit of the electronic device to a set of threshold voltages to determine a type of the headphone, the detection circuit including a first path, a second path, and a bias capacitor;

determining the headphone to be a first type when a first signal travels through the first path to ground; and determining the headphone to be a second type when a second signal travels through the second path to charge the bias capacitor to a reference voltage.

2. The method of claim 1, wherein the set of threshold voltages includes first and second threshold voltages, wherein the first and second signals are first and second currents, wherein the headphone is determined as the first type when the detected voltage level is less than the first threshold voltage, wherein the headphone is determined as the second type when the detected voltage level is between the first and second threshold voltages, and wherein the second signal travels through the first path and the second path to charge the bias capacitor to the reference voltage.

3. The method of claim 1, wherein the first type is a 3-pole headphone type and the second type is a 4-pole headphone type.

4. The method of claim 2, wherein the first threshold voltage is determined using the reference voltage, a resistance value of a bias resistor, and a minimum resistance value of a microphone resistor.

5. The method of claim 2, wherein the second threshold voltage is determined using the reference voltage, a resistance value of a bias resistor, and a maximum resistance value of a microphone resistor.

6. The method of claim 1, further comprising:

activating a monitor circuit and an analog-digital-converter (ADC) during an on-duration of each detection cycle when the headphone is determined to be the first type, the monitor circuit including the first path and a monitor switch, the on-duration being shorter than a period of each detection cycle; and comparing an output value of the ADC to a threshold value.

7. The method of claim 6, further comprising:

determining the headphone as the second type and terminating the detection when the output value of the ADC is equal to or greater than the threshold value.

8. The method of claim 6, further comprising:

comparing a number of detection cycles to a given number of detection cycles when the output value of the ADC is less than the threshold value;

terminating the detection and determining the headphone as the first type when the number of detection cycles is equal to the given number of detection cycles; and repeating the detection when the number of detection cycles is less than the given number of detection cycles.

9. The method of claim 1, further comprising:

activating a monitor circuit and an analog-digital-converter (ADC) during an on-duration of each detection cycle when the headphone is determined to be the second type, the monitor circuit including the first path and a monitor switch, the on-duration being shorter than a period of each detection cycle; and comparing an output value of the ADC to a threshold value.

10. The method of claim 9, wherein the reference voltage is a first reference voltage, the method further comprising:

activating a micbias circuit to charge the bias capacitor to a second reference voltage when the output value of the ADC is equal to or less than the threshold value, the micbias circuit including a buffer and the bias capacitor, the second reference voltage having a voltage level that is substantially higher than a voltage level of the first reference voltage; and activating the ADC to identify the operation of one of controllers included in the headphone, and wherein the controllers are switching devices each configured to control a function in a system associated with the headphone.

11. The method of claim 9, further comprising repeating the monitoring when the output value of the ADC is greater than the threshold value.

12. A system comprising:

a detection circuit including a first path, a second path, and a bias capacitor;

a processor; and a non-transitory computer readable medium having computer executable instructions stored thereon which, when executed by the processor, performs the following method:

comparing a voltage level detected by the detection circuit to a set of threshold voltages to determine a type of a headphone;

determining the headphone to be a first type when a first signal travels through the first path to ground; and determining the headphone to be a second type when a second signal travels through the second path to charge the bias capacitor to a reference voltage.

13. The system of claim 12, wherein the set of threshold voltages includes first and second threshold voltages, wherein the first and second signals are first and second currents, wherein the headphone is determined to be the first type when the detected voltage level is less than the first threshold voltage, wherein the headphone is determined to be the second type when the detected voltage level is between the first and second threshold voltages, and wherein the second signal travels through the first path and the second path to charge the bias capacitor to the reference voltage.

14. The system of claim 12, wherein the first type is a 3-pole headphone type and the second type is a 4-pole headphone type.

15. The system of claim 12, wherein the detection circuit further includes an analog-digital-converter (ADC) configured to generate an output value corresponding to a voltage level at an input of the ADC.

16. The system of claim 15, wherein the output value of the ADC has 8 data bits.

17. The system of claim 15, wherein the detection circuit further includes a monitor circuit coupled to the input of the ADC, the monitor circuit having the first path and a monitor switch.

18. The system of claim 17, wherein the detection circuit further includes a buffer, and wherein the input of the ADC is coupled to an output of the buffer through the second path.

19. The system of claim 18, wherein the first path has a monitor resistor and the second path has a bias resistor, a resistance value of the monitor resistor being greater than a resistance value of the bias resistor.

* * * * *